US006089417A

United States Patent [19]

Snekkenes et al.

[11] Patent Number: 6,089,417

[45] Date of Patent: Jul. 18, 2000

[54] CHIP BIN

[75] Inventors: Vidar Martin Snekkenes, Karlstad; Sven-Erik Olsson, Sunne; Per Johan Erik Nyström; Kenneth Olof Bellström, both of Karlstad, all of Sweden

[73] Assignee: Kvaerner Pulping AB, Sweden

[21] Appl. No.: 09/193,258

[22] Filed: Nov. 17, 1998

[30] Foreign Application Priority Data

Oct. 9, 1998 [SE] Sweden ..... 9803443

[51] Int. Cl.[7] ..... B65D 88/26; B65B 39/00

[52] U.S. Cl. ..... 222/460; 141/331; 141/333; 222/564

[58] Field of Search ..... 222/185.1, 460, 222/541, 547, 564; 141/331, 333, 334; 4/144.4

[56] References Cited

U.S. PATENT DOCUMENTS

| | | | |
|---|---|---|---|
| 529,998 | 11/1894 | Beall | 141/331 |
| 619,836 | 2/1899 | Paradis | 141/331 |
| 2,031,616 | 2/1936 | Nall | 222/460 |
| 2,184,830 | 12/1939 | Boisseau | 222/460 |
| 4,886,097 | 12/1989 | Garza-Ondarza | 222/460 |
| 4,958,741 | 9/1990 | Johanson | 222/460 |
| 5,803,140 | 9/1998 | Jodoin | 141/333 |

*Primary Examiner*—Kevin Shaver
*Assistant Examiner*—Keats Quinalty
*Attorney, Agent, or Firm*—Fasth Law Offices; Rolf Fasth

[57] ABSTRACT

Chip bin comprising, an upper container part, a discharge opening, and, arranged between the container part and the discharge opening, a discharge zone, preferably without moving parts, the discharge zone having a curvilinear roller shape in any freely chosen horizontal cross-section and the number of corners in the geometrical curvilinear figure of the cross-section is more than two, preferably three, in that the cross-section of the discharge zone decreases from the container part (5) down towards the discharge opening (4), and in at least one section of the discharge zone having a downwardly continuously decreasing curvilinear roller shaped cross-section.

19 Claims, 8 Drawing Sheets

CHIP BIN

The present invention relates to a chip bin which is used within the pulp industry and is used for storing and possibly steaming chips for producing pulp.

TECHNICAL FIELD

The most common design of chip bins includes some form of outlet device in order to ensure continuous discharge, such as for example the frequently used so-called "Vibra Bin". A disadvantage of such chip bins is that they are relatively expensive to maintain, among other things because of wear and the necessary maintenance associated therewith.

BACKGROUND INFORMATION & SUMMARY OF THE INVENTION

A chip bin which works entirely without moving parts is previously known through U.S. Pat. No. 4,958,741. If the climate allows, such a chip bin can function satisfactorily. The principle is based on the cross-section of the chip bin being reduced in stages down towards the discharge opening in a manner which eliminates the risk of bridge formation and consequently, with certain climatic prerequisites, continuous discharge can be ensured with such a design.

The known device is based on the alternating use of oval and circular cross-sections. Such a construction leads to a disadvantage in that the oval cross-section is not optimal as far as strength is concerned. Furthermore, it is relatively complicated to manufacture and is therefore expensive.

Another chip bin which also works entirely without moving parts is previously known through SE 505 498. The known device is entirely based on the use of circular cross-sections. Although tests have shown that such a bin would function in a satisfying manner under most conditions, we did discover that under some special conditions there is a risk of bridge formation.

Now we have surprisingly revealed that all of the above problems can be eliminated by the use of reuleaux-shaped cross-sections.

The aim of the present invention is to produce a chip bin which is based on a principle of functioning preferably totally without moving parts but at the same time eliminates the above mentioned disadvantages of the known embodiments.

The solution is based on a chip bin comprising an upper container part (5), a discharge opening (4), and, arranged between the container part (5) and the discharge opening (4), a discharge zone (2, 3), preferably without moving parts, wherein the discharge zone (2, 3) in any freely chosen horizontal cross-section has a curvilinear roller shape and the number of corners in the geometrical curvilinear figure of the cross-section is more than two, preferably three, in that the cross-section of the discharge zone decreases from the container part (5) down towards the discharge opening (4), and in at least one section of said discharge zone essentially having a downwardly continuously decreasing curvilinear roller shaped cross-section.

DETAILED DESCRIPTION

The term curvilinear and reuleaux triangle will now be described in detail.

A curvilinear geometrical figure (roller) consists of curves instead of straight lines. It can be constructed by choosing any radius, drawing an unspecified number of arcs which do not have the same centre points and joining these arcs. A special type of curvilinear geometrical figures (rollers), what is called reuleaux rollers, have unique properties. They have e.g. constant width and constitute of a odd number of arcs and have a maximum angle of 60° for any arc used to generate the rollers.

Constant width can be explained as follows. The circumference of a non-circular figure can be considered to constitute of a unspecified number of points $n_1$ to $n_x$ and forming a closed curve. The tangent in a freely chosen point $n_1$ on the circumference has a normal directed towards the inner part of the figure. The line forming the normal intersects the circumference in the point $n_2$. The length of the line forming the normal between the two points $n_1$ and $n_2$, is L. If a tangent in new point $n_3$ is chosen, the length of the normal between the point $n_3$ and the new intersection point $n_4$ is also L. The length L, the width, of the normal to a tangent in a freely chosen point between the freely chosen point and the intersection point is always the same in a figure if it is a reuleaux roller.

The angle of an arc is the angle the radius describes when it is moved along the arc between the two endpoints of the arc.

The reuleaux triangle is constructed from an equilateral triangle. It consists of the vertices of the equilateral triangle and three arcs of circles. Each arc of circle has centre at one of the vertices and endpoints at the other two vertices. The radius of the arc of circle is the side of the equilateral triangle.

The shape of the cross section in the actual non-circular chip bin is a reuleaux-triangle with rounded vertices.

Figure 1:
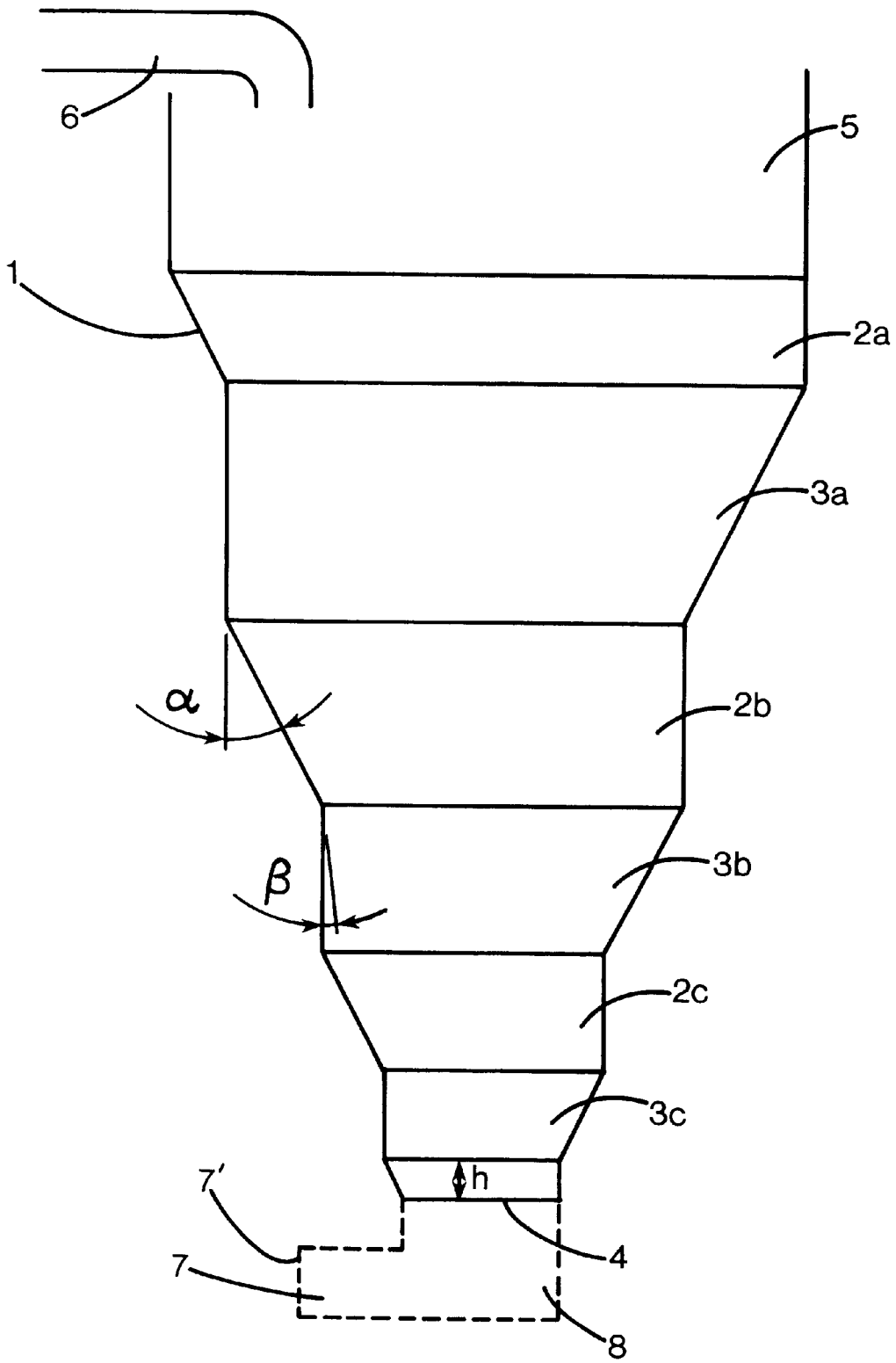
FIG. 1 shows a diagrammatic side view of a chip bin according to the invention.

A first embodiment of the invention will be described in greater detail below. FIG. 1 shows a side view of a chip bin 1 with a discharge zone 2, 3 according to the invention. The discharge zone comprises a number of rounded reuleaux-triangle units 2*a,* 2*b,* 2*c,* 2*d,* 3*a,* 3*b,* 3*c.* The largest rounded reuleaux-triangle unit 2*a* is located uppermost in the discharge part of the chip bin and the smallest rounded reuleaux-triangle unit 2*d* is located at the bottom and thus itself also forms the discharge opening 4 from the chip bin 1. Between the larger and the smaller rounded reuleaux-triangle units, five further rounded reuleaux-triangle units 3*a,* 2*b,* 3*b,* 2*c,* 3*c* are located, the width of which decreases gradually in relation to the largest, upper unit 2*a*.

Figure 2:
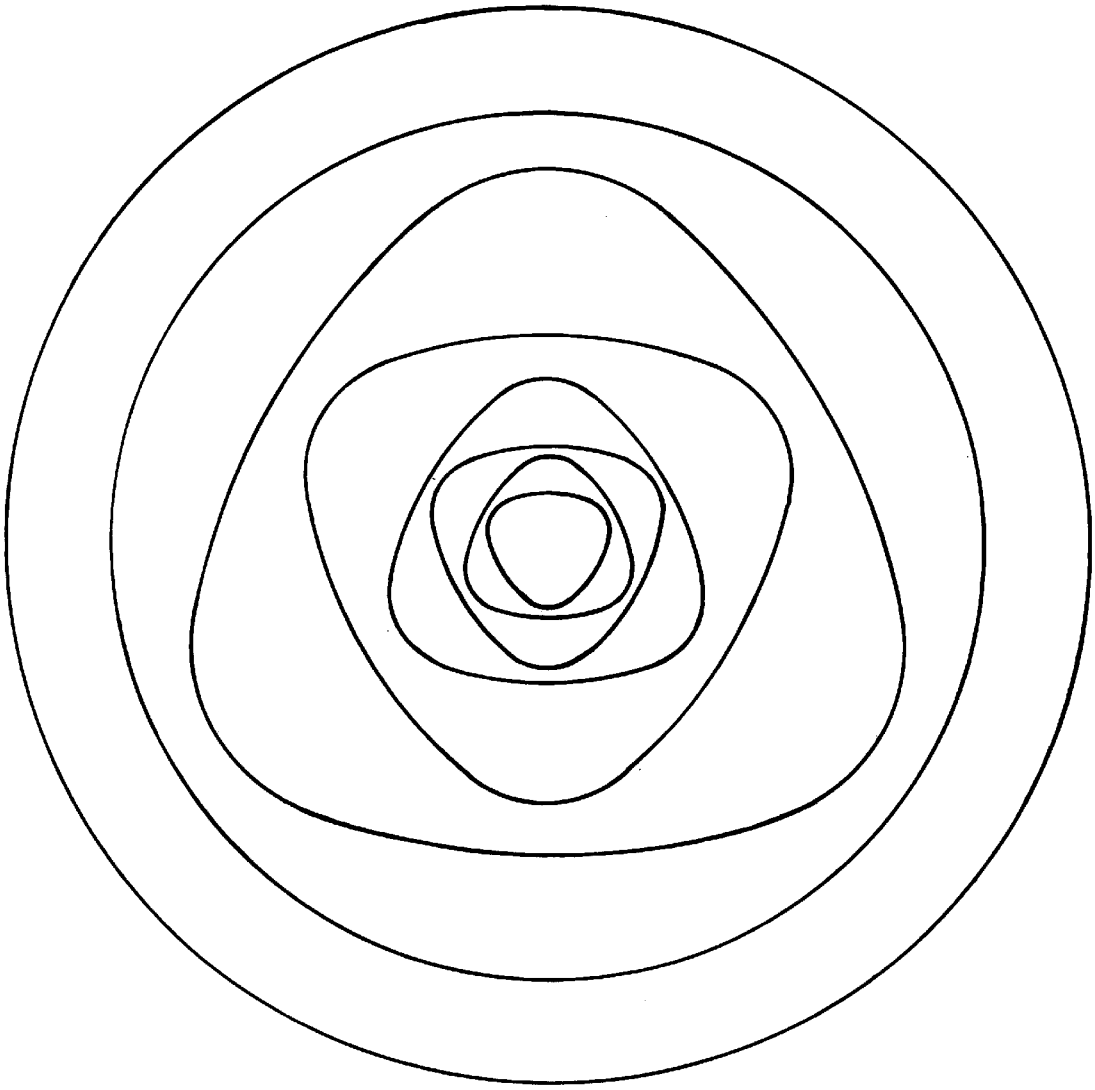
FIG. 2 shows the same embodiment in a view from above.
Figure 3:
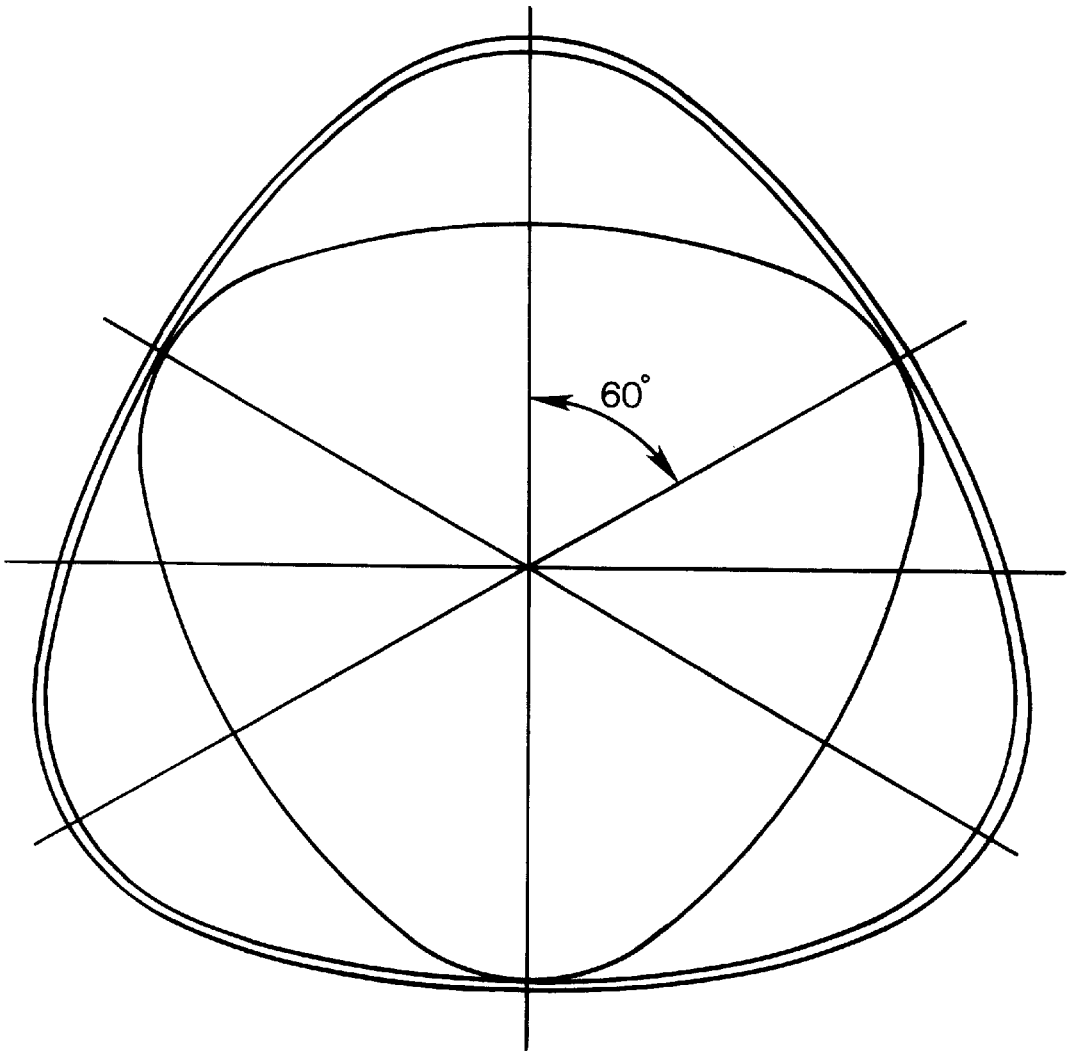
FIG. 3 shows the reuleaux-triangle with rounded vertices and the angle of rotation.
Figure 4B:
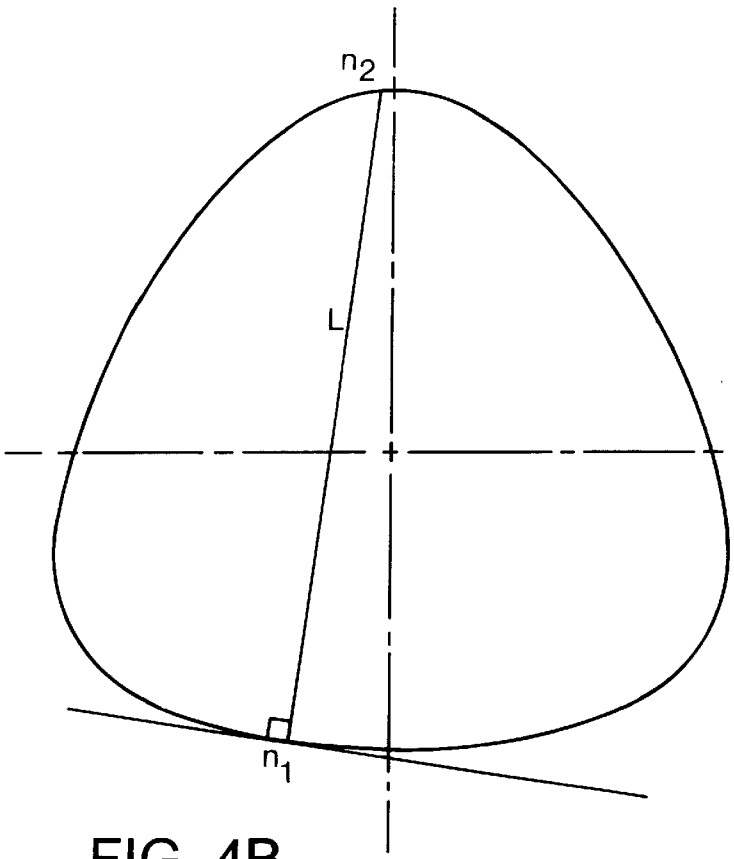
FIG. 4 shows diagrammatic the construction of the reuleaux-triangle with the rounded vertices.
Figure 4A:
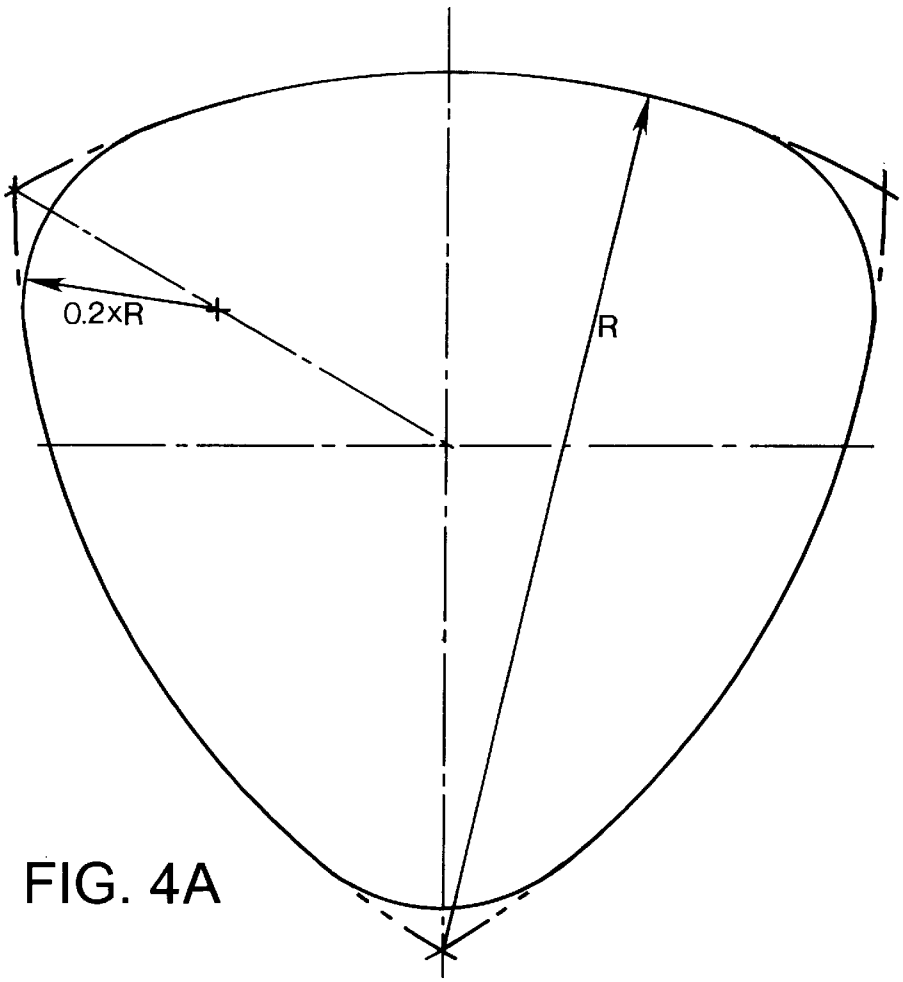

Each rounded reuleaux-triangle unit is turned 60° in relation to the rounded reuleaux-triangle unit immediately above or below, see FIG. 2 and 3.

Each rounded reuleaux-triangle unit 2, 3 getting narrower downwardly essentially has the shape of a modified truncated tetraeder. Above the discharge part 2, 3 described above, a container part 5 is situated, the design of which may vary but which expediently has a circular cross-section and has upwardly a decreasing width so that a certain clearance is obtained along the inner periphery. At the top of the bin 1, a feeding device 6 (not described further) is arranged, which may consists of a pipe which is fed via a belt or screw conveyor (not shown). The outlet opening 4 can be connected to chip measuring device 8 which is shown only diagrammatically in the figure. In most cases, as indicated diagrammatically in FIG. 1, a chip meter 7' known per se is arranged between the steaming vessel 7 and the outlet opening.

The bin functions in such a manner that chips are fed in at the top and flow into the bin at the top through the feeding device 6. The feed flow is controlled in relation to the discharge flow and the quantity of chips present in the bin in such a manner that the desired chip level is obtained in the bin 1. Discharge of chips from the bin takes place entirely according to the principle of unassisted falling. The chips can fall out of their own accord without bridge formation because the outlet opening 2*d* has a height h which is sufficiently small, in relation to the width (L), to eliminate the occurrence of bridge formation, smaller than 2 L, preferably smaller than 1.5 L and most preferably smaller than L. When discharge of chips is then made possible (for example by the feed screw in a steaming vessel 7 exposing the outlet opening 4), the quantity of chips present in the bottom cylindrical part 2*d* falls out first.

Figure 5:
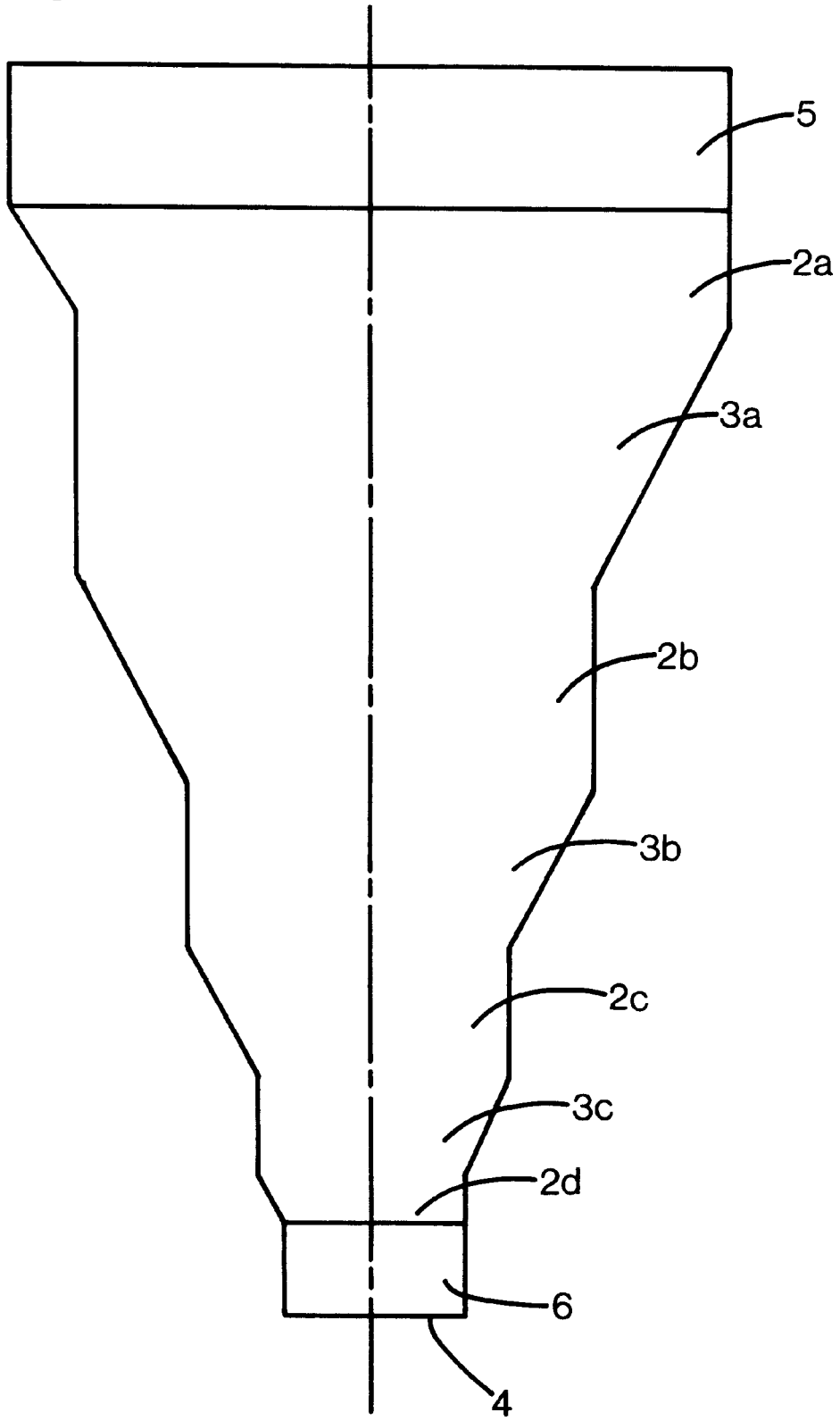
FIG. 5 shows a diagrammatic side view of a preferred embodiment of a chip bin according to the invention.
Figure 6:
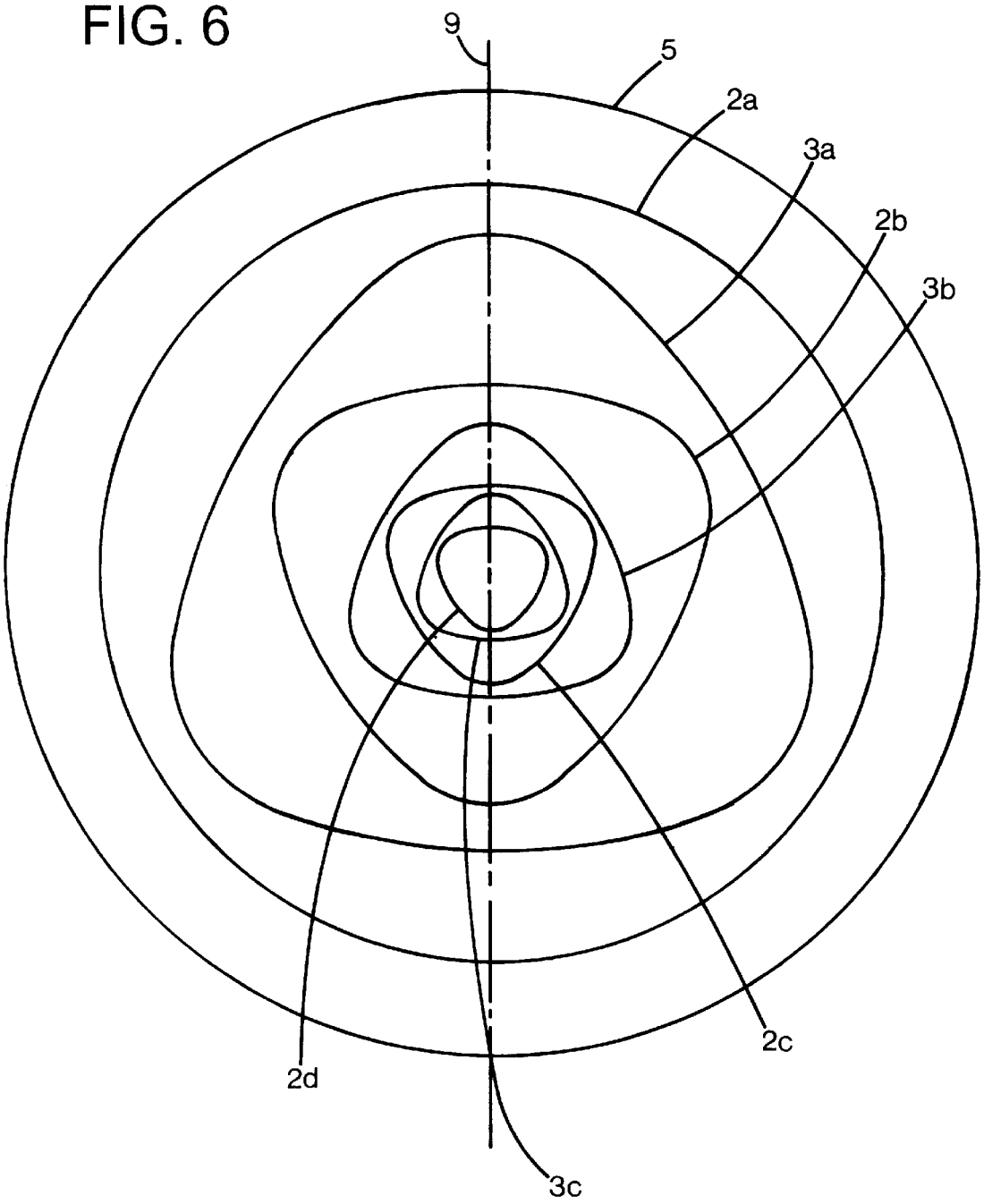
FIG. 6 shows the same preferred embodiment from above.

FIGS. 5 and 6 show a preferred embodiment of a reuleaux-chip bin according to the invention. Between the upper cylindrical container unit 5 and the lower discharge part 6, 7 sections 2*a,* 3*a,* 2*b,* 3*b,* 2*c,* 3*c,* 2*d* are arranged. Each such section has in any freely chosen horizontal cross-section a reuleaux-triangle-formed shape which continuously decreases in the downward direction towards the outlet opening 4. According to the preferred embodiment, the height (h) of each section 2,3 is such that it is shorter than 2 times the maximum width of the section.

FIG. 6 shows, with the aid of a view from above, how the various sections 2*a,* 3*a,* 2*b,* 3*b,* 2*c,* 3*c,* 2*d,* are positioned in relation to one another, the line of symmetry for each section lying in one and the same vertical plane 9. The principle of functioning for this preferred embodiment is the same as for that described above.

Figure 7:
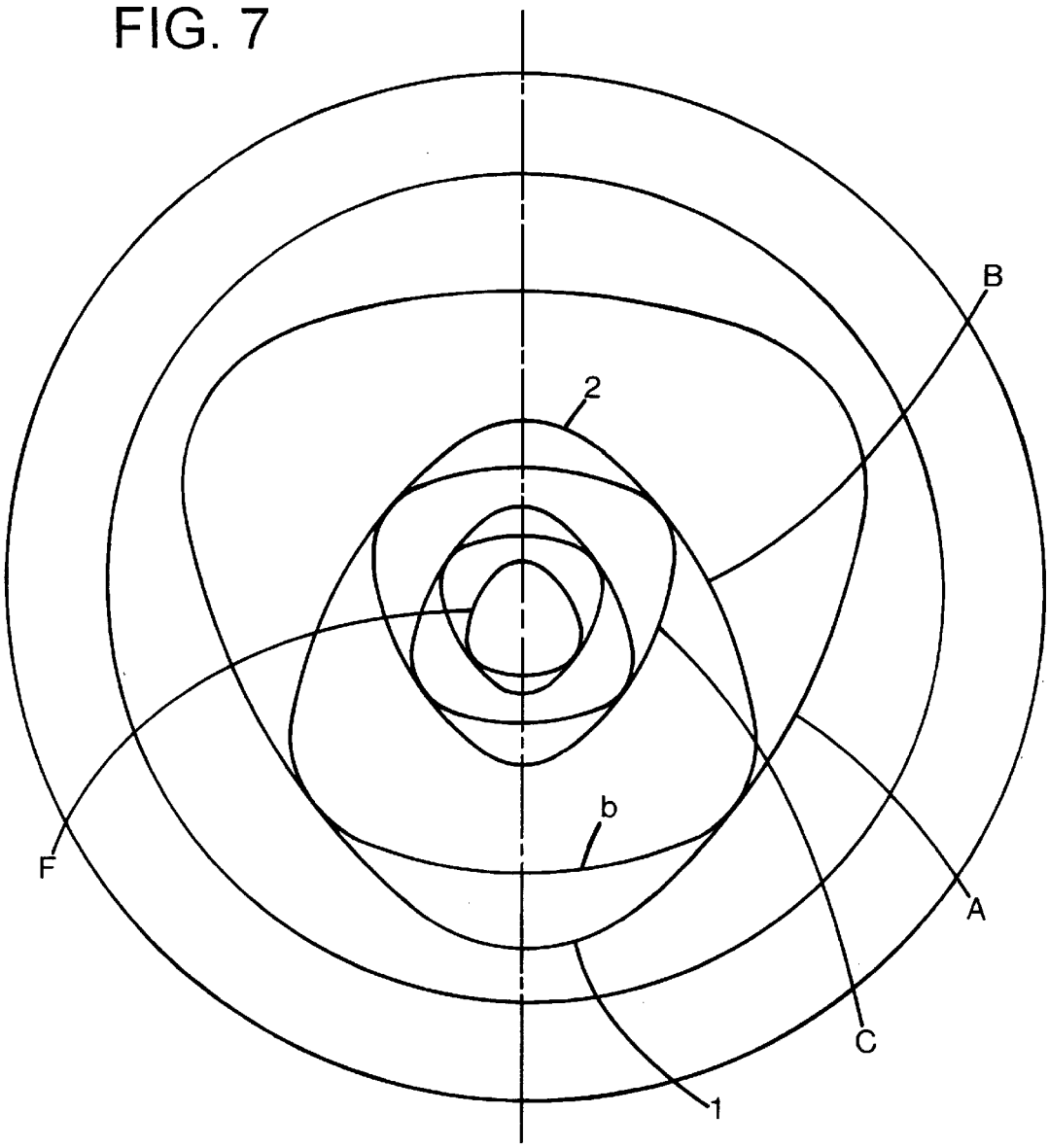
FIG. 7 shows an embodiment of a chip bin according to the invention from above.
Figure 8:
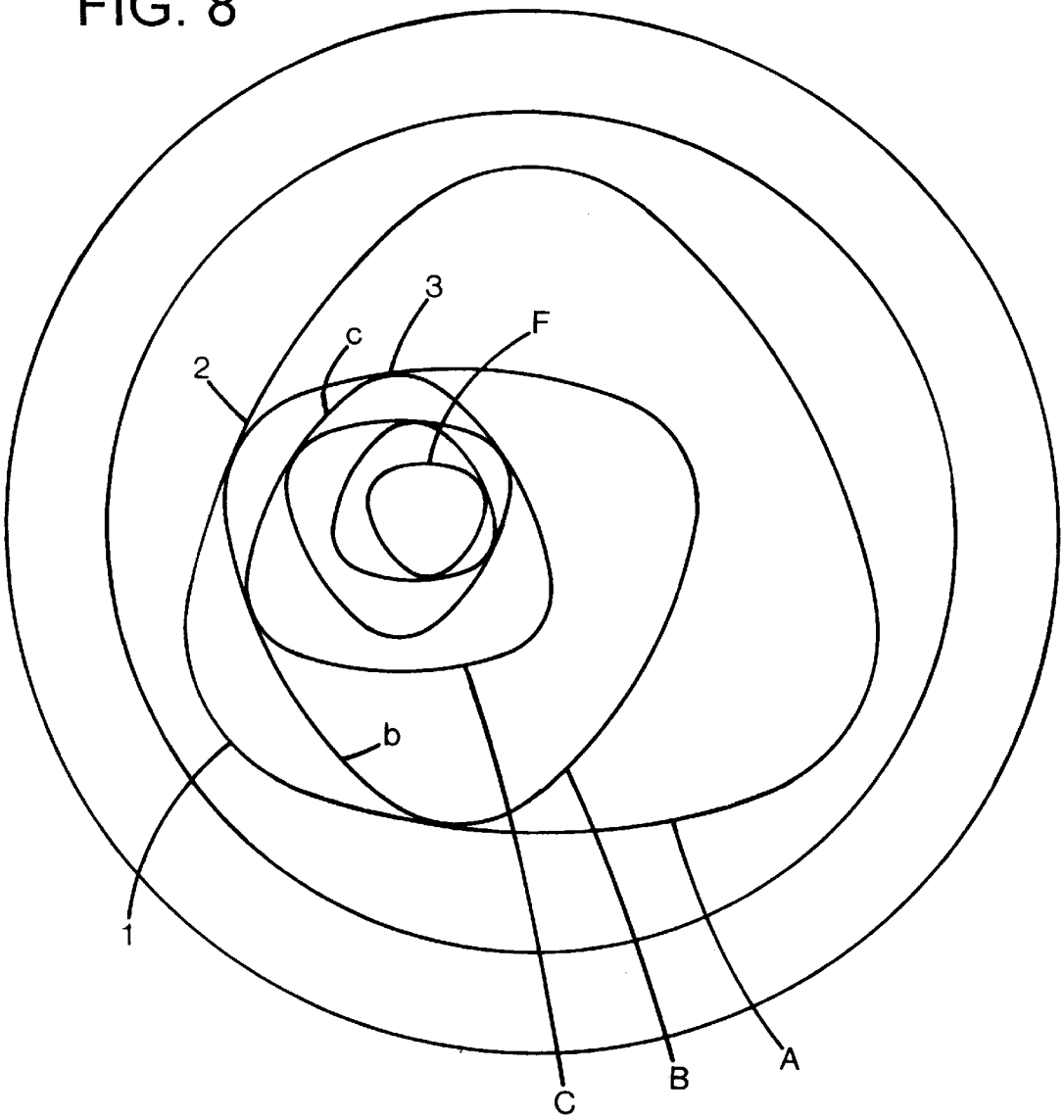
FIG. 8 shows an embodiment of a chip bin according to the invention from above.

FIGS. 7, and 8 show alternative embodiments of the reuleaux-chip bin according to the invention. FIG. 7 shows a chip bin where the reuleaux-shaped sections have been positioned along a vertical line a—a in a non-centred manner in relation to each other. This is achieved by displacing the smaller under reuleaux-shaped section B so one curvilinear side b is directed towards the vertex 1 of the bigger upper reuleaux-shaped cross-section A along line a—a. The following smaller reuleaux-section C is then also displaced in relation to the upper cross section B in the way that one curvilinear side c is directed towards the vertex 2 of the upper section B along line a—a. This way of displacing the sections along vertical line a—a is repeated until the lowermost section F is reached.

FIG. 8 shows a chip bin where the reuleaux-shaped sections have been displaced 60° in a non-centred manner in relation to each other. The reuleaux-shaped section A has three vertices of which one is marked with the number 1. The following reuleaux-shaped cross-section B below is displaced 60° in relation to the section A in the way that the curvilinear side b is directed towards the vertex 1. The following reuleaux-shaped cross-section C is also displaced 60° in relation to the section A in the way that the curvilinear side c is directed towards the vertex 2 of reuleaux section B. This way of displacing the gradually smaller reuleaux-sections is then repeated until the lowermost reuleaux-section F is reached.

The following test results are a summary of the tests carried out. All the parameters, except the geometrical shape of the models, were held as constant as possible in each test. Accordingly, the test results will reflect which effect the geometrical shape of the cross section in each model has upon the number of stops and the total operating time.

The used models were made on the scale of 1:10. All of the models have the following dimensions: The diameter of the top inlet of the conical part is 478 mm. The diameter of the conical outlet of the conical part is 120 mm.

The wood chips that were chosen is a fraction having its greatest dimensions of 3×5×30 mm. The reason that this fraction was chosen is that the flow pattern of this wood chips was satisfying similar in all the models and that the discharge could be made using a conventional chip meter.

A. Conical Referens Model

The referens model is a single cone made of metal sheet and with a conicity of 14,5°. The height is 700 mm.

B. Oval Model

The dimensions for the model have been collected from the U.S. Pat. No. 4,958,741. The conical bottom part has a height of 700 mm. The oval model is manufactured of fibre glass fibre plastic.

C. The reuleaux Model

To avoid sharp corners in the reuleaux model the corners have a radius of 0.2× the large radius. The maximum declination of the section is 25°. The height is 769 mm and the model is manufactured of fibre glass reinforced plastic.

D. The Circular Model

Kvaerner has the patent for this model. The number of sections is the same as for the oval model. In comparison with the oval model (B) and the reuleaux model (C) the cross section are circular. The maximum declination in each section is 25°. This circular model is manufactured of plastic-coated metal sheet to get the similar friction coefficient as the model B and C respectively.

1. The wood chips were filled in the bin part, about 130 liters. The cylindrical bin part was altered between the different discharge models. No active compaction was taken place and the same procedure was repeated in all the tests. Discharge of the chips took place entirely according to the principle of unassisted falling.

2. The chip meter was driven so a normal discharge capacity was obtained. A dwell time of about 5–10 minutes.

3. The operating time between each stop was recorded, see the table. To raise the stop it was necessary to hit against the conical part of the bin. At recurrent stops the wood chips were packed and on the whole it was difficult to empty the bins.

Test comp.=Test completed

Test discon.=Test discontinued

TABLE A

Conical Model

| Test | The number of stops | | | | | | | Test | Test disc |
|---|---|---|---|---|---|---|---|---|---|
| No. | 0 | 1 | 2 | 3 | 4 | 5 | 6 | comp | on |
| | Operating time between each stop | | | | | | | | |
| 1 | | 8.8 min | 1 min | 2 s | 3 s | 3 s | | | X |
| 2 | | 3.8 min | 4 s | 5 s | | | | | X |

TABLE B

Oval Model

| Test | The number of stops | | | | | | | Test comp | Test disc |
|---|---|---|---|---|---|---|---|---|---|
| No. | 0 | 1 | 2 | 3 | 4 | 5 | 6 | 1 | on |
| | Operating time between each stop | | | | | | | | |
| 1 | | 3.4 min | 9 s | 13 s | | | | | X |
| 2 | | 3.6 min | 1.9 min | 46 s | 20 s | | | | X |
| 3 | 5 min | | | | | | | X | |
| 4 | | 2.4 min | 4.1 min | | | | | | X |
| 5 | | 1.9 min | 24 s | 2.1 min | | | | X | |

TABLE C

Reuleaux Model

| Test | The number of stops | | | | | | | Test comp | Test disc |
|---|---|---|---|---|---|---|---|---|---|
| No. | 0 | 1 | 2 | 3 | 4 | 5 | 6 | 1 | on |
| | Operating time between each stop | | | | | | | | |
| 1 | 10.1 min | | | | | | | X | |
| 2 | 8.3 min | | | | | | | X | |
| 3 | 8.8 min | | | | | | | X | |

TABLE C-continued

Reuleaux Model

| Test | The number of stops | | | | | | | Test comp | Test disc |
|---|---|---|---|---|---|---|---|---|---|
| No. | 0 | 1 | 2 | 3 | 4 | 5 | 6 | 1 | on |
| 4 | 10.3 min | | | | | | | X | |
| 5 | 7.2 min | | | | | | | X | |

TABLE D

Conical model

| Test | The number of stops | | | | | | | Test comp | Test disc |
|---|---|---|---|---|---|---|---|---|---|
| No. | 0 | 1 | 2 | 3 | 4 | 5 | 6 | 1 | on |
| | Operating time between each stop | | | | | | | | |
| 1 | | 30 s | 20 s | 1 s | 5 s | 45 s | 3 s | | X |
| 2 | | 55 s | 8 s | 8 s | 8 s | 5 s | | | X |

As can be seen above solely the reuleaux-triangle chip bin did complete each test run without any stop. The above tests show that under certain conditions (increased wall friction) the functioning thereof is better than if any other cross-sectional form is used, e.g. circular or oval. In each vertex of the reuleaux-shaped cross-section the inclination of the wall is as steepest. It means that compared to cross-sections with e.g. circular or oval shape, where one or at a maximum two steeply inclinated walls can be obtained, in the roller shaped chip bin according to the invention at least three steeply inclinating walls can be obtained in each section. This makes plugging in the chip bin more difficult.

Another advantage of the reuleaux-triangle chip bin is that the line of symmetry for each section can lie in one and the same vertical plane. This makes the design work easier.

It is therefore obvious that the preferred embodiment according to the invention has clear advantages in comparison with using other cross-sections such as for example circular cross-sections.

It is obvious that the invention can be modified as far as the preferred embodiment shown above is concerned but still be covered by the following patent claims. It is for example possible to produce a bin with both fewer and more sections than have been shown and also with varying degrees of inclination.

Moreover, it is possible to deviate from the reuleaux-triangular cross-section and instead have a other type of curvilinear geometrical figure (roller).

The choice of material can of course be adapted to specific requirements and made for example of composite material, but the most preferred material is sheet metal. It is furthermore understood that the invention can also be used for discharging material other than chips, for example pellets or granulate.

We claim:

1. A chip bin, comprising:

an upper container part;

a first discharge zone attached to the upper container part and disposed below therof, the first discharge zone having a first opening;

a second discharge zone attached to the first discharge zone and disposed below thereof, the second discharge zone having a second opening that is smaller than the first opening, the first and second discharge zones having a curvilinear roller shape, the first and second discharge zones having a horizontal cross-section having at least two corners, the first discharge zone having a downwardly continuously decreasing curvilinear roller shaped cross section; and a discharge opening unit disposed below the second discharge zone, the discharge opening unit having a discharge opening including a portion being smaller than the second opening.

2. The chip bin according to claim 1 wherein the curvilinear roller shape of the second discharge zone is rotated at least 15° relative to the curvilinear roller shape of the first discharge zone.

3. The chip bin according to claim 2 wherein the curvilinear roller shape of the second discharge zone is rotated at least 30° relative to the curvilinear roller shape of the first discharge zone.

4. The chip bin according to claim 2 wherein the curvilinear roller shape of the second discharge zone is rotated about 60° relative to the curvilinear roller shape of the first discharge zone.

5. The chip bin according to claim 1 wherein the downwardly continuously decreasing curvilinear roller shaped cross section of the first discharge zone has a steepest inclination at one of the corners of the second discharge zone.

6. The chip bin according to claim 1 wherein the horizontal cross-sections of the first and second discharge zones each has a perimeter having a plurality of points ($n_1$) to ($n_x$) placed thereon, each point (n) has an inwardly extending tangential normal that has a constant length (L) when the tangential normal extends inwardly and intersects the perimeter.

7. The chip bin according to claim 1 wherein the chip bin has a third discharge zone disposed between the second discharge zone and the discharge opening unit.

8. The chip bin according to claim 1 wherein the horizontal cross sections of the first and second discharge zones each has the shape of a reuleaux triangle with rounded vertices.

9. The chip bin according to claim 1 wherein the horizontal cross sections of the first and second discharge zones each has at least three arcs.

10. The chip bin according to claim 1 wherein the first discharge zone has a first side wall and an opposite second side wall, the first side wall is substantially vertical and the second side wall slopes in a second direction to form an angle alpha with a vertical axis, the angle alpha is between about 15° and 35°.

11. The chip bin according to claim 10 wherein the angle alpha is between about 20° and 30°.

12. The chip bin according to claim 10 wherein the angle alpha is about 25°.

13. The chip bin according to claim 10 wherein the first side wall slopes in a first direction, that is opposite the slope in the second direction of the second side wall, to form an angle beta with the vertical axis, the angle beta is less than 10°.

14. The chip bin according to claim 13 wherein the angle beta is less than 5°.

15. The chip bin according to claim 13 wherein the angle beta is less than 3°.

16. The chip bin according to claim 1 wherein the first and the second discharge zones have the shape of a truncated tetrahedron.

17. The chip bin according to claim 1 wherein the first discharge zone has a first width (L) and a first height that is between about 0.3L and about 1 L.

18. The chip bin according to claim 12 wherein the first height is between about 0.4L and about 0.9L.

19. The chip bin according to claim 17 wherein the first height is about 0.5L.

* * * * *